US006446457B1

(12) United States Patent
Taylor

(10) Patent No.: US 6,446,457 B1
(45) Date of Patent: Sep. 10, 2002

(54) FAN AND TUNNEL WITH FANS

(75) Inventor: Robert Taylor, Wavre (BE)

(73) Assignee: L'Air Liquide Societe Anonyme a Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 09/860,433

(22) Filed: May 21, 2001

(30) Foreign Application Priority Data

May 23, 2000 (FR) ..... 00 06558

(51) Int. Cl.[7] ..... F25D 25/04; F25D 17/04; F25D 17/06; F04D 29/54

(52) U.S. Cl. ..... 62/380; 62/415; 62/416; 62/419; 426/393; 415/199.3; 415/185

(58) Field of Search ..... 29/889.4; 34/576; 62/183, 374, 378, 380; 415/199.3; 426/393

(56) References Cited

U.S. PATENT DOCUMENTS

| | | | | | |
|---|---|---|---|---|---|
| 1,699,201 | A | | 1/1929 | Guth | |
| 2,765,748 | A | * | 10/1956 | Buchi | 415/199.3 |
| 3,260,443 | A | * | 7/1966 | Garnett | 29/889.4 |
| 5,123,261 | A | * | 6/1992 | Cope | 62/374 |
| 5,168,711 | A | * | 12/1992 | Moore et al. | 62/374 |
| 5,478,584 | A | * | 12/1995 | Donohue et al. | 426/393 |
| 5,520,013 | A | * | 5/1996 | Kuo | 62/378 |
| 5,551,251 | A | * | 9/1996 | Ochs et al. | 62/380 |
| 5,765,381 | A | * | 6/1998 | Renz | 34/576 |
| 5,878,582 | A | * | 3/1999 | Appolonia et al. | 62/374 |
| 6,298,682 | B1 | * | 10/2001 | Ramos et al. | 62/183 |

FOREIGN PATENT DOCUMENTS

| | | | |
|---|---|---|---|
| DE | 2 165 610 | | 7/1973 |
| FR | 667 554 | | 10/1929 |
| GB | 212123 | | 3/1924 |
| GB | GB-212123 | * | 3/1924 |

OTHER PUBLICATIONS

Search Report issued in French Application No. 0006558.

* cited by examiner

*Primary Examiner*—William C. Doerrler
*Assistant Examiner*—Filip Zec
(74) *Attorney, Agent, or Firm*—Burns, Doane, Swecker & Mathis, L.L.P.

(57) ABSTRACT

A intended in particular for equipping a tunnel for refrigeration of products such as food products, wherein this tunnel has a gaseous current flowing through it. The fan includes at least one pair of funnels (1) fixed onto one face of a support (2) mounted so that it can rotate about a vertical axis (XX) and connected to a device for driving rotation. The funnels have their entrance apertures (4) arranged radially so as to allow the gaseous current to penetrate into them and to emerge from them at an accelerated speed via their exit aperture (S). One or several fans [according to the invention] can be arranged at appropriate places in the tunnel, their rotation speed being chosen so that the exit gas currents from the funnels ensure a high degree of heat transport while reducing the risk of undesirable movement of products passing by on a conveyor placed below the fans.

4 Claims, 1 Drawing Sheet

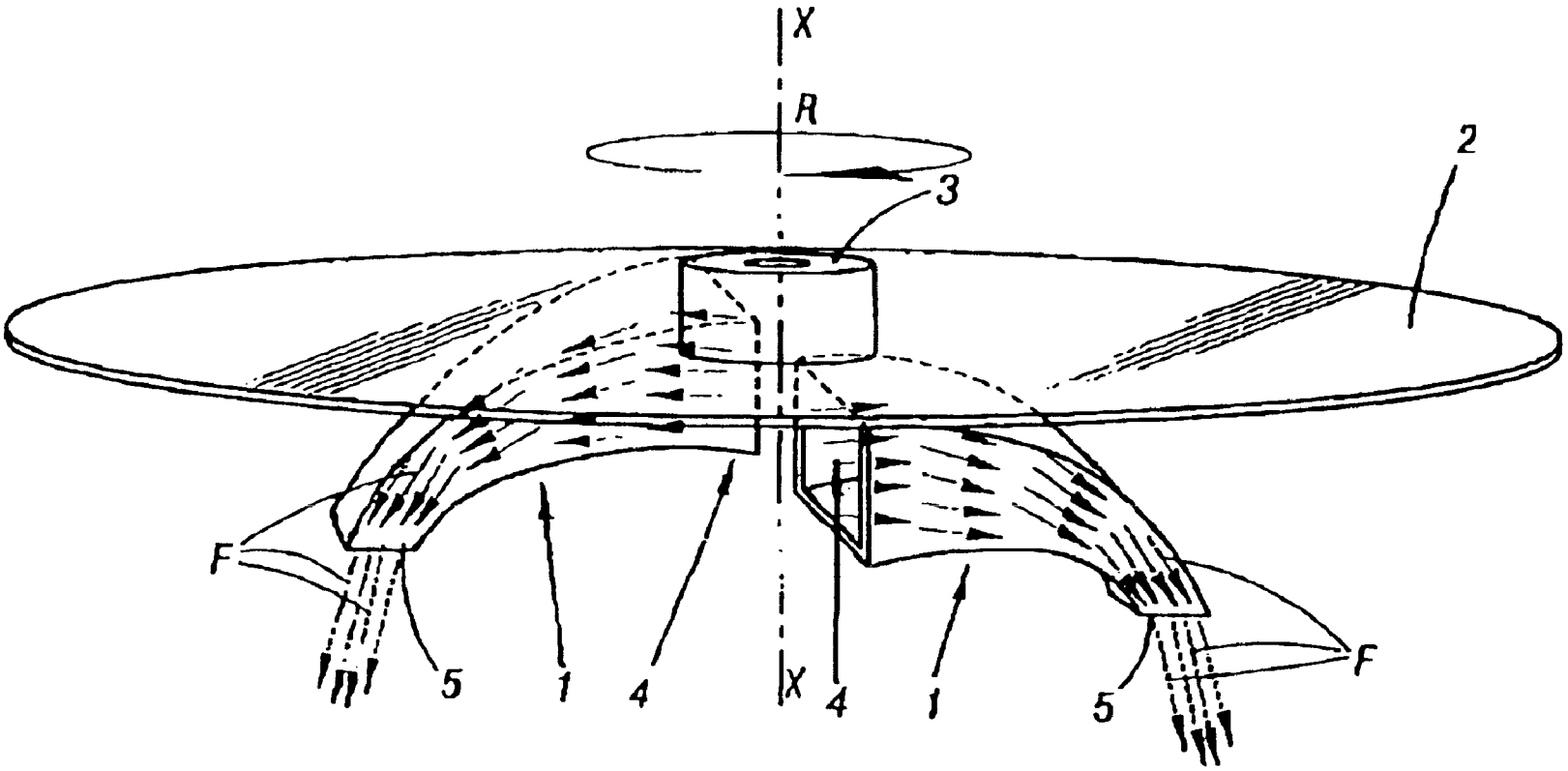
2
3
X
R
F
5
1
4
X
4
1
5
F

FAN AND TUNNEL WITH FANS

BACKGROUND OF THE INVENTION

1. Field of the Invention

The object of the present invention is a fan intended in particular for equipping a tunnel for refrigeration of products such as food products, and also the tunnel equipped with such a set of fans.

2. Description of the Related Art

It is known that in cryogenic tunnels for refrigeration of food products a cold gaseous current is circulated which ensures heat transfer by convection between the cold gas and the food product to be refrigerated. The aim is to ensure high levels of heat transfer without damaging or moving the products on the belt of the conveyor, while minimising the energy dissipated inside the cryogenic tunnel.

This type of tunnel has been used for more than thirty years with a wide variety of fans and of devices to ensure the necessary gas movement. The most common fans act axially and are fitted so as to blow downwards in the direction of the food product. Centrifugal fans which push the gas transversely to the products are also used. The heat transfer coefficients of such systems normally lie between 45 and 90 $W/m^2/°$ C. Tunnels optimised for treatment of products that are in principle thin such as small hamburger rounds use gaseous vortices whose heat transfer coefficient is about 120 $W/m^2/°$ C. or which produce gaseous jets impinging on the products with a heat transfer coefficient greater than 200 $W/m^2/°$ C.

The gaseous vortices normally require that the gas flows away through zones not covered by the belt of the conveyor, which limits their application to products which do not completely cover the belt of the conveyor, an upper limit of 65% for the coverage of the belt being usual.

The gaseous impact systems are normally based on fans which create an overpressure in a relatively large volume of the tunnel. The gaseous jet impacts are produced by a gas which is expelled from a high pressure volume through a plurality of holes, or of channels. So that these impact systems can be used in cryogenic tunnels, they must be easy to clean, and special characteristics are required to maintain their performance owing to the potential presence of snow and of ice formed in the holes and tubes or the channels.

In many cases, problems arise in connection with excessive transverse air currents or suction towards the fans which can cause movement of light products on the conveyor. For most products which could be moved, such movement is unacceptable as it can damage or modify the shape of the product or make it come out of alignment with the other products, even when that alignment is intended to allow a subsequent process such as automatic packing.

For products which are not particularly fine, the highest heat transfer coefficients do not contribute major advantages in terms of treatment speed, as the thermal diffusion capability of the products limits the rate of heat transfer from the products.

The object of the invention is therefore to propose a fan designed to remedy these disadvantages.

SUMMARY OF THE INVENTION

The fan concerned in the invention is intended in particular to equip a tunnel for refrigeration of products such as food products, this tunnel having a cold gaseous refrigerating current flowing through it.

According to the invention, this fan comprises at least one pair of funnels fixed onto one face of a support mounted so that it can rotate about a vertical axis and connected to a means of driving rotation, and these funnels have their entrance apertures arranged radially so as to allow the gaseous current to penetrate into them and to emerge from them at an accelerated speed via their exit aperture.

A set of these fans can be appropriately arranged inside the tunnel, and the funnels of each fan can be profiled to generate a gaseous jet moving for example at a speed of 20 to 30 m/sec and which impinges on the product to be refrigerated. The high speed of the gaseous jet emerging from the fans provides high levels of heat transfer as the boundary layer around the product is very thin. The action of the fan does not create high suction flows nor zones of very low pressure, which makes it possible advantageously to minimise any movement of the products.

The cryogenic tunnel also concerned in the invention is equipped with a set of these fans, arranged to direct cold gaseous currents locally at an accelerated speed onto predetermined zones of the conveyor.

BRIEF DESCRIPTION OF THE FIGURE OF THE DRAWING

Other features and advantages of the invention will become apparent in the course of the following description, given with reference to the appended diagram and which illustrates one form of implementation as a non-limiting example.

The single FIGURE is a simplified perspective view of one form of implementation of a fan according to the invention, intended to equip for example a cryogenic tunnel.

DETAILED DESCRIPTION OF THE PREFERRED EMBODIMENT

The fan shown in the appended FIGURE is intended in particular to equip a tunnel for refrigeration of products such as food products.

It comprises at least one pair of funnels 1 fixed onto one face of a support 2 mounted so that it can rotate about a vertical axis XX and connected to a means of driving rotation not shown, such as an electric motor. The support 2 can for example consist of a disc equipped axially with a spindle 3 suitable for receiving an output shaft from the drive motor.

The two funnels 1 and 2 are fixed diametrically opposite on a lower face of the disc 2 arranged in an approximately horizontal plane. Their entrance apertures 4 can have any outline, for example rectangular as shown, and are preferably situated approximately in a same diametric plane of the disc 2. The funnels 1 are curved downwards in the direction opposite to the direction of rotation R of the disc 2. The cross-section of the body of each funnel decreases gradually along the curvature thereof until an exit aperture 5 of small diameter.

Thus when the disc 2 is set in rotation around the vertical axis XX, the cold gas current is taken into the entrances 4 and flows within the funnels 1 as shown by the set of arrows F, at an accelerated speed. After passing through the exit apertures 5, the gas currents impinge on the products to be refrigerated, not shown, arranged below the disc 2 on the band of a passing conveyor, which is not shown.

A set of such fans can be arranged in well defined zones of the tunnel, in which a high degree of heat transfer by convection has to be ensured. These fans are thus situated where they are considered most advantageous for the functioning of the tunnel. For example they can be arranged at the entrance, where the surface of the products can be refrigerated while minimising their dehydration and creating an abrupt temperature gradient within the product. It can also be placed close to a cryogenic injection point, where there is a very large temperature difference between the gas and the product to be refrigerated.

The rotation speed of the fan can vary widely to optimise its performance depending on the products to be refrigerated. Cryogenic injection into the path of these funnel fans can be exploited to control the formation of frosting or to increase the heat transfer of the injection zone. The structure of these funnel fans is optimised to produce efficient gas movement and to allow easy cleaning. These fans reduce the risk of movement of light products while ensuring a high degree of heat transfer by convection.

When fans according to the invention are used in the liquid nitrogen injection zone (cryogenic injection zone), a ring can be vaporised around the fan to effect an atomisation towards the axis of the fan. The funnel fan collects the aerosol and directs a combination of cold gas and droplets of liquid nitrogen entrained thereby directly onto the product at high speed. The aerosol of liquid nitrogen provides an additional advantage by cleaning off any formation of snow or frost before it can diminish the aerodynamic performance of the funnel fan. The latter has been found effective at low temperatures but can also be used at high temperatures, for example for continuous cooking systems.

What is claimed is:

1. A fan useful for equipping a tunnel for refrigeration of products such as food products, this tunnel having a gaseous current flowing through it, the fan comprising:

a support rotatable about a vertical axis and including a face and means for connecting the support a device for rotating the support about the vertical axis; and at least one pair of funnels fixed onto the face of the support the funnels each including an exit aperture and an entrance aperture, the entrance apertures arranged radially so as to allow the gaseous current to penetrate into them and to emerge from them at an accelerated speed via their exit apertures.

2. A fan according to claim 1, wherein the support comprises a disc having a face on which the funnels are fixed diametrically opposite with their entrance apertures situated approximately in a same diametric plane, and the funnels are curved downwards and in the direction opposite to the direction of rotation of the disc.

3. A cryogenic tunnel useful for refrigeration of products such as food products passing by on a conveyor and wherein a cold gas current can circulate, the tunnel comprising at least one fan according to claim 1 arranged to direct cold gaseous currents locally at an accelerated speed onto predetermined zones of the conveyor when the support of the fan is rotated about the vertical axis.

4. A cryogenic tunnel useful for refrigeration of products such as food products passing by on a conveyor and wherein a cold gas current can circulate, the tunnel comprising at least one fan according to claim 2 arranged to direct cold gaseous currents locally at an accelerated speed onto predetermined zones of the conveyor when the support of the fan is rotated about the vertical axis.

* * * * *